United States Patent [19]

Stucky

[11] 4,045,937

[45] Sept. 6, 1977

[54] METHOD OF CONSTRUCTING A PREFABRICATED ROOM ELEMENT AND A BUILDING OF A PLURALITY OF SAID ELEMENTS

[75] Inventor: Fritz Christoph Stucky, Baar, Switzerland

[73] Assignee: Credelca A.G., Zug, Switzerland

[21] Appl. No.: 481,917

[22] Filed: June 21, 1974

[30] Foreign Application Priority Data

June 21, 1973 United Kingdom ..... 29447/73

[51] Int. Cl.[2] ..... E04B 1/35; E04H 1/00

[52] U.S. Cl. ..... 52/745; 52/79.1; 52/236.3; 52/492

[58] Field of Search ..... 52/745, 79, 492, 236, 52/495, 745, 496, 747, 263, 282

[56] References Cited

U.S. PATENT DOCUMENTS

| | | | |
|---|---|---|---|
| 3,416,273 | 12/1968 | Stucky et al. | 52/745 X |
| 3,474,582 | 10/1969 | Wah et al. | 52/282 X |
| 3,494,092 | 2/1970 | Johnson et al. | 52/745 X |
| 3,500,595 | 3/1970 | Bennett | 52/236 X |
| 3,688,458 | 9/1972 | Inmon | 52/495 X |
| 3,696,574 | 10/1972 | Dietrich | 52/236 |
| 3,751,127 | 8/1973 | Black, Jr. et al. | 52/495 X |
| 3,757,477 | 9/1973 | McCrillis | 52/745 X |
| 3,758,998 | 9/1973 | Ollis et al. | 52/745 X |
| 3,871,146 | 3/1975 | Hamy | 52/236 X |

FOREIGN PATENT DOCUMENTS

| | | | |
|---|---|---|---|
| 1,525,887 | 4/1968 | France | 52/745 |
| 1,937,365 | 1/1970 | Germany | 52/79 |
| 2,101,593 | 1/1970 | Germany | 52/79 |
| 1,194,372 | 6/1970 | United Kingdom | 52/79 |

*Primary Examiner*—Leslie Braun
*Attorney, Agent, or Firm*—Brumbaugh, Graves, Donohue & Raymond

[57] ABSTRACT

A transportable prefabricated room element having a floor panel structure and a vertical load-bearing structure and comprising a floor panel having a horizontally extending channel therein, a vertical structure having a vertically extending channel therein and a load-bearing frame forming an integral part of the transportable room element and comprising a horizontal load-bearing beam engaged in said horizontally extending channel and a vertical load-bearing beam engaged in said vertically extending channel.

7 Claims, 4 Drawing Figures

9'
9'
20
29
8b'
29
3d"
14'
3c"
28
4"
9'
29
20
29
9'
30
6'
6'
28
4"
3b"
8a'
14'
3a"
5'
10'
31
5'
10'
32
13'
31
32
30

METHOD OF CONSTRUCTING A PREFABRICATED ROOM ELEMENT AND A BUILDING OF A PLURALITY OF SAID ELEMENTS

This invention relates to buildings and specifically to transportable prefabricated room elements for erection into a single storey, or a plural storey, building.

The expression "transportable prefabricated room element" is employed herein to define a transportable prefabricated cell-like structure having two opposed sides and two opposed ends constituting four faces of the cell and comprising a floor panel structure and a vertical load-bearing structure rigidly connected to the floor panel structure for supporting parts of the building (such for example, as a roof or ceiling or the floor panel structure of a superimposed room element) extending over and positioned above the floor panel structure, which element is adapted to be mounted face-to-face with a further such element in building up a storey, or part of a storey, of a building from a plurality of such elements. The expression "face-to-face" includes side-by-side, end-to-end, and end-to-side. The expression "vertical load-bearing structure" includes a vertical load-bearing wall and spaced vertical load-bearing columns. The said columns may support fill-in panelling to close, or partly close, a face of the structure, and the expression "fill-in panelling" includes a wall panel, a door, or a window, and in the case of a wall panel the latter may be integral with the two columns between which it extends or may be attached to them. Such room elements and buildings incorporating them form the subject of British patent specifications Nos. 1,101,597; 1,101,385; 1,068,172; 1,027,241; 1,027,242; 1,034,101; 1,250,883 and 1,271,024 to which reference may be made for further particulars.

It has been proposed to fabricate such room elements on the basis of a load-bearing frame or chassis which consists of initially separate components viz, a reinforced floor panel and reinforced vertical load-bearing end structures, the latter being rigidly connected to opposite ends of the panel.

Such room elements are intended to be fabricated in a substantially complete manner at a factory remote from the building site. In particular such electrical wiring, plumbing and heating installations, doors, partitions, glazing and interior finish, as are required in the complete building are applied to the room elements at the factory so as to bring them to a substantially finished condition. The room elements are then transported to the building site and there assembled into a building to which only the minimum finishing work such for example as concealing joint lines needs to be carried out.

The floor panels are generally made of reinforced concrete and hence their size and weight brings problems in their casting and handling. Also, the system does not readily permit room elements of various sizes to be constructed, for that would entail the use of a number of expensive moulds for the floor panels.

Moreover the use of a single prefabricated floor panel imposes a limitation on the size in which the room elements can be economically constructed.

Finally it will be appreciated that the room elements have to be prefabricated and finished while they are travelling along a production line. Their mere bulk renders transport along a production line difficult and the operations which have to be carried out in that production line render progress along it very slow. A further drawback is the limited access of workmen which renders it difficult for two teams to work simultaneously.

To overcome some or all of these drawbacks it has been proposed to form the floor panel structure as a plurality of prefabricated floor panel sections and to rigidly connect the floor panel sections in edge-to-edge assembly by post-tensioning means. Whilst this proposal is effective in overcoming some or all of the aforesaid drawbacks, it does have disadvantages in that unless the abutting edges of the floor panel sections are accurately formed, and this is difficult to achieve when casting in concrete, inaccuracies will occur in the floor panel structure when the floor panel sections are post-tensioned in edge-to-edge assembly and such inaccuracies will be magnified in any walls or like structures mounted on or formed integrally with the floor panel sections.

The present invention provides a transportable prefabricated room element as herein defined comprising a floor panel having a horizontally-extending channel therein, a vertical structure having a vertically-extending channel therein and a load-bearing frame forming an integral part of the transportable room element and comprising a horizontal load-bearing beam engaged in said horizontally extending channel and a vertical load-bearing beam engaged in said vertically extending channel.

The invention also provides a building having at least one storey comprising a plurality of room elements according to the present invention.

The invention further provides a method of constructing a building which comprises prefabricating a plurality of room elements according to the present invention and mounting the elements face-to-face and/or one upon another to form a single or plural storey building.

The floor panel may comprise a plurality of floor panel sections each having a portion of said horizontally extending channel therein, the floor panel sections being rigidly connected in edge-to-edge assembly by said horizontal beam.

Said load-bearing frame provides the load-bearing structure of the room element. Thus, the floor panel only has to support, apart from its own weight, the usual loads imposed on the floor of a building, and the vertical structure, which may be a wall, need only be self-supporting. Accordingly the floor panel and the vertical structure can be of a lighter construction than hitherto or can be formed from a material which is lighter in weight and easier to fabricate than reinforced concrete, e.g., from a material comprising a mixture of gypsum, cement and sand. Manufacture is facilitated in that a room element, or a section thereof, can be brought to an advanced stage of manufacture, e.g., can be provided with interior partition walls, doors, windows, surface finishes, electrical fittings and installations, plumbing, sanitary installations, fitted cupboards, kitchen fixtures or fittings and the like before it is provided with said load-bearing frame and accordingly before it becomes extremely heavy and cumbersome to handle. This is particularly so when the floor panel is formed in sections since different sections can be passed along different production lines and formed into different cell units, e.g., into sanitary units, kitchen units or the like having substantially all fittings and installations required in that part of the room element, thus providing a great deal of flexibility in manufacture and enabling more rationalized production than has hitherto been the case.

The room element may comprise spaced vertical structures each having a vertically extending channel therein, the load-bearing frame comprising spaced vertical load-bearing beams each of which is engaged in a said vertically extending channel. Such spaced vertical structures may be located at or adjacent the opposed ends of the room element and said load-bearing frame may be in the form of a U.

Said channels may be formed in a side margin of the floor panel and the or each vertical structure.

The floor panel may have spaced horizontally-extending channels therein, e.g., extending longitudinally of the room element, and the or each vertical structure may have spaced vertically extending channels therein, the load-bearing frame comprising spaced horizontal load-bearing beams engaged in said horizontally extending channels and spaced vertical load-bearing beams engaged in said spaced vertically extending channels. Said channels maybe formed in opposite side margins of the floor panel and the or each vertical structure.

The load-bearing frame may comprise one or more intermediate beams extending between said spaced horizontal load-bearing beams and/or between said spaced vertical load-bearing beams. Such intermediate beams may be cross-beams extending laterally of the room element. Preferably the or each said intermediate beam is received in a channel in the floor panel or a said vertical structure. Where the floor panel comprises sections rigidly connected in edge-to-edge assembly by said horizontal load-bearing beams, the floor panel sections may have open-sided channels in the mating edges thereof which cooperate to form a closed channel for the reception of a said intermediate beam. A said intermediate beam may extend between the lower ends of said spaced vertical load-bearing beams and/or between the upper ends of the spaced vertical load-bearing beams.

The or each said vertical structure may be a wall or may be in the form of a column or columns, e.g., spaced columns connected at their upper ends by a head beam.

The beams comprising said load-bearing frame may be formed from steel, e.g., may be box-section beams or U-, I-, or H-section girders.

At least those parts of the floor panel and the vertical structure or structures defining said channels may be formed from a fireproof building material.

At least one of said channels may be an open-sided channel with which a said beam is engaged by inserting it through the open side. The or each such channel may open downwardly or to one side of the room element. The open-sided channel may be such as to receive a said beam wholly therewithin and may be closed by a cover panel of concrete or other fireproof building material. Alternatively the or a said channel may be adapted to cooperate with a like channel of another like room element to form a closed channel for a said beam. According to another embodiment at least one of said channels is an open-ended closed-sided channel into which a said beam is inserted through the open end. In any of these ways the beams of the load-bearing frame can be totally enclosed in fireproof material such as concrete, and this is of importance where the beams are of steel since exposed steel can constitute a fire hazard in a building.

The floor panel and /or the or each vertical structure may be non-load-bearing. The floor panel and/or the or each vertical structure may be cast or extruded using a suitable building material, preferably a castable or extrudable building material which exhibits little or no change in volume on curing such as a suitable mixture of gypsum, cement and sand. The or each said vertical structure may be formed, e.g., cast, integrally with the floor panel or a section thereof or may be formed independently of the floor panel.

Shear transmitting means may be inserted between the floor panel and the or each horizontal load-bearing beam. Such shear transmitting means may comprise one or more pads, strips or bands of a suitable elastomeric material such as Neoprene.

If a said vertical structure is required to be braced, e.g., to withstand wind forces, then one or more cross-braces, e.g. intersecting diagonally-extending cross-braces, may be incorporated therein. The or each such cross-brace may be secured at its ends to a said vertical load-bearing beam.

The room element may further comprise one or more non-load-bearing vertical walls, e.g., exterior walls or internal partition walls. Where the floor panel is formed in sections at least one of said sections may have at least one non-load-bearing vertical wall formed, e.g., cast or extruded, integrally therewith.

The room element may also comprise a cell unit prefabricated prior to incorporation in the room element and having substantially all fittings and installations, e.g., electrical wiring and fittings, plumbing, sanitary fittings, doors, windows, decorative surface finishes, or the like, required in that part of the room element. The cell unit may have a floor which forms a section of the floor panel of the room element. Alternatively the cell unit could be open at the bottom or have its own floor and be mounted on the floor panel of the room element.

The load-bearing frame may be connectable to the load-bearing frame of a like room element when the room elements are incorporated in a building, so that the frames of the individual room elements combine to form the structural load-bearing frame of the building. Thus a building having a strong load-bearing moment-resisting structural frame can be constructed in a simple and convenient manner since the structural frame of the building is formed in sections which are incorporated in the room elements and is built up as the individual room elements are mounted in position.

The channels which receive the load-bearing beams may be filled, e.g., injected, with a suitable material such as mortar or a suitable synthetic resin to inhibit corrosion of the beams and to bond the beams to the floor panel or vertical structure. Such filling of the channels can be effected either during the prefabrication of the room element or during construction of a building from a plurality of room elements. In this latter case the channels of adjacent room elements may be aligned to form continuous channels extending over more than one room element and the channels then filled so that the filling material at least assists in connecting the room elements together.

The individual room elements are preferably so designed that when they are incorporated in a building at least the vertical load-bearing beams of superposed room elements or at least the horizontal load-bearing beams of adjacent room elements will be aligned. Such aligned load-bearing beams can be connected together in any suitable manner as by welding, bolting or dowel connections, either with or without the interposition of bearing pads, e.g., of a suitable elastomeric material such as Neoprene.

The invention will be further described with reference to the accompanying drawings in which.

Figure 1:
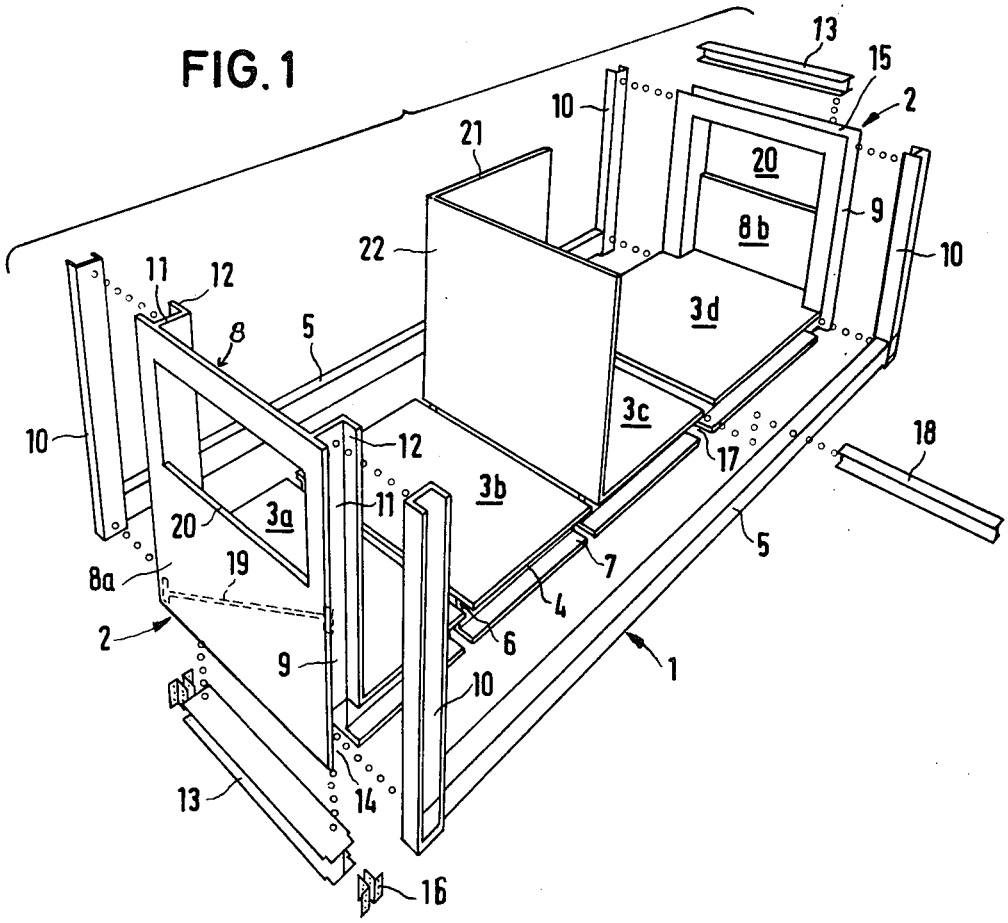
FIG. 1 shows one embodiment of a prefabricated room element according to the present invention in exploded diagramatic perspective view.

The room element illustrated in FIG. 1 comprises a floor panel structure 1 and two vertical load bearing structures 2 which are substantially of room height.

The floor panel structure 1 comprises a plurality of prefabricated floor panel sections 3*a*, 3*b*, 3*c*, 3*d*, having longitudinal channels 4 in opposed side margins thereof and two horizontal load-bearing beams 5 which engage the longitudinal channels 4 to rigidly connect the floor panel sections in edge-to-edge assembly. The joints between the floor panel sections may be filled with a suitable filler material such as mortar. Each of the floor panel sections is provided on its underside with downwardly extending web portions 6 and outwardly extending flange portions 7 which, with the side margins of the floor panel, define the longitudinal channels 4. Said web portions 6 and flange portions 7 are formed, e.g., cast, integrally with the floor panel sections.

The vertical load-bearing structures 2 each comprise a wall panel 8 having vertically extending channels 9 in opposed side margins thereof and vertical bad-bearing beams or uprights 10 which engage the vertically extending channels 9. As with the floor panel sections 3, the vertically extending channels 9 are defined, with the side margins of the wall panel 8, by web portions 11 and outwardly extending flange portions 12. The wall panels 8 are formed integrally with the floor panel sections 3*a* and 3*d* respectively and the vertically extending channels 9 thereof communicate with the longitudinal channels 4 of their respective floor panel sections. The vertical load-bearing structures 2 have been shown as being located at opposite ends of the room element. It will be understood, however, that one or both of the structures 2 could be spaced inwardly of an end of the room element or that one or more additional vertical load-bearing structures, e.g., similar to the structures 2 or comprising only a vertical load-bearing column or columns, could be provided intermediate those illustrated. The uprights 10 are each rigidly connected at their lower ends to a horizontal load-bearing beam 5. The beams 5 and the uprights 10, shown in FIG. 1, consist of either U- section or H-section steel girders and are connected to each other by welding, although they can be bolted or otherwise connected together. The beams 5 and/or uprights 10 could alternatively be produced from reinforced concrete with a solid section. The beams 5 and their associated uprights 10 can be combined to form a single U-shaped frame or frame part for one side of a room element.

The vertical load-bearing structures 2 further comprise cross-beams 13. In FIG. 1 there are shown two embodiments of such a cross-beam 13. The wall panel 8*a* has in the lower side margin thereof a laterally extending channel 14 similar to the channels 4 and 9. In this channel 14 there is inserted a cross-beam 13 which can be connected at its ends to the uprights 10 as by means of brackets 16. The wall panel 8*b* has at the top thereof a laterally extending channel 15 for a cross-beam 13. Though it is not shown, this cross-beam 13 can also be connected at its ends to the uprights 10. Likewise, if desired or necessary the abutting ends of adjacent floor panel sections 3*a* to 3*d* define therebetween a closed channel 17 which receives a cross-beam 18, the ends of which may be connected to the horizontal load-bearing beams 5. The wall panels 8 may incorporate one or more cross-braces 19 which are connected at their ends to the uprights 10. In this embodiment the floor panel sections 3 and the wall panels 8 are formed from a castable or extrudable fireproof building material such as a mixture comprising gypsum cement and sand of the kind sold under the trade name "Liant 45." Such a material has the advantage that it is light in weight compared with ordinary concrete and exhibits little or no change in volume on curing. Fastening and/or tensioning means can be cast into the material.

The horizontal load-bearing beams or girders 5 and the uprights 10 may be such as to be received wholly within the channels or recesses 4 and 9 respectively and the channels or recesses 4 and 9 may be closed by suitable cover plates, e.g., in the form of cladding walls, of concrete or other fireproof building material. If, on the other hand, a side face of the room element is to be mounted face-to-face with another similar room element then the arrangement may be such that the channels or recesses 4 and 9 of the two room elements cooperate to form closed channels for the beams or girders 5 and the uprights 10.

The wall panels 8 may comprise windows or window openings 20 and/or may comprise a door or door opening.

The floor panel section 3*c* comprises two walls 21 and 22, which are formed integrally therewith. The wall 21 forms part of an outside wall of the room element, while the wall 22 forms an interior partition wall. These walls can also be provided with openings for windows or doors.

Figure 2:
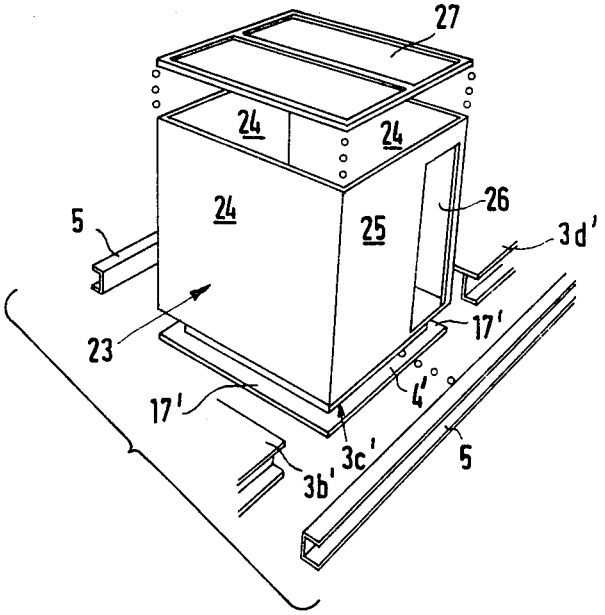
FIG. 2 shows a section of another embodiment of a room element according to the invention also in exploded view.

In FIG. 2 there is shown a second embodiment of the invention. The illustrated floor panel section 3*c*′ is a modification which is shown together with a room element according to the one illustrated in FIG. 1. The floor panel section 3*c*′ is an integral part of a cell unit 23 and forms the floor of the cell unit. The cell unit 23 comprises three plain walls 24 and a wall 25 provided with a door opening 26. The cell unit 23 may be formed as a so-called sanitary cell and may be equipped with the necessary sanitary fittings and installations, plumbing and the like. The cell unit 23 is provided with a ceiling 27, which is shown in FIG. 2 in exploded view. The floor panel section 3*c*′ comprises channels 4′ and channels 17′ which are arranged below the cell floor and which surround the cell unit and which communicate with each other. The channels 17′ have the same cross-section as the channels 4′ and wholly receive a cross-beam 18 (FIG. 1). The floor panel sections 3*b*′ and 3*d*′, which are arranged adjacent to the floor panel section 3*c*′, do not have channels 17′ facing the floor panel section 3*c*′. When the floor panel sections 3*b*′ and 3*d*′ are arranged end-to-end with the floor panel section 3*c*′, the open-sided channel 17′ is closed by the adjacent floor panel sections.

The cell unit 23 is square in plan view and can accordingly be arranged within the room element in the orientation shown or in any one of three further orientations in which the cell unit is turned through 90°, 180° or 270° so that the door opening 26 faces in a required direction.

Such cell units may be prefabricated for many purposes. They can be formed, for example, as a kitchen unit, or as a living room or bedroom unit. If desired such a cell unit or cell units could be rectangular in plan, in which case the cell unit could be arranged in two different orientations at 180° to each other.

Figure 3:
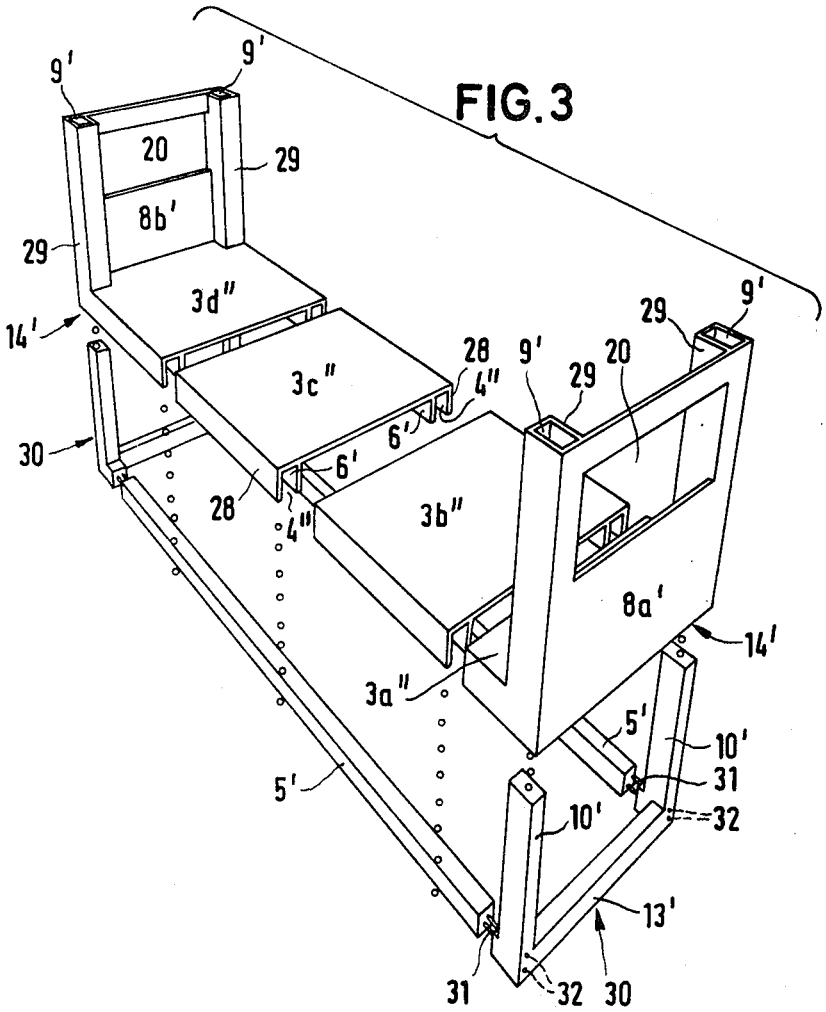
FIG. 3 shows a further embodiment of a room element according to the invention also in exploded view.

FIG. 3 shows another embodiment of a room element according to the invention. This room element comprises floor panel sections 3*a*'' to 3*d*'', of which the floor panel sections 3*a*'' and 3*d*'' are integrally formed with the respective vertical wall panels 8*a*' and 8*b*'. The floor panel sections have downwardly opening U-shaped channels 4'', the legs of which are formed by a flange portion 28 which extends vertically downwardly from the side margin of the floor panel section and by another flange portion 6' which is spaced from and parallel to the flange 28. The wall panels 8*a* and 8*b* each comprise two hollow columns 29, which project into the interior of the room element and which define closed vertical channels 9''. At the bottom of the floor panel sections 3*a*'' and 3*d*'' there are downwardly opening channels 14' which are formed in similar manner to the channels 4''.

For those end faces of the room element which carry the vertical wall panels 8*a*' and 8*b*', there are provided U-beams 30. These U-beams each comprise a cross-beam 13' and two integral uprights 10'. Two beams 5' provided for the longitudinal sides of the room element are connected to these U-beams by means of bolts 31 and apertures 32. The beams 5' and 30 together form a load-bearing frame onto which the floor panel sections 3*a*'' to 3*d*'' can be lowered from above together with the wall panels 8*a*' and 8*b*'. In so doing the vertical channels 9' are slidden over the uprights 10'. After assembly, the channels 4' of the floor panel sections engage the beams 5' and the channels 14' engage the cross-beams 13'. The floor panel sections 3*b*'' and 3*c*'' can simply rest upon the beams 5' with their channels 4' engaged therewith. At this point the room element is substantially finished, no further connections or tensioning means between the parts being necessary. If desired, the joints between the floor panel sections can be filled with a suitable filler material such as mortar.

The open bottom sides of the channels 4' and 14' may be closed by cover panels (not shown) of fireproof material or by the ceiling or other upper part or parts of the room element directly beneath when the room element is incorporated in an upper storey of a building, in order to provide fire protection for the load-bearing frame, e.g., when this is of metal. Any joints between the room element and the cover panels or room element directly beneath can be filled, e.g., with a suitable fire resistant caulking material.

Any of the floor panel sections of the embodiment of FIG. 3 may be formed as a part of a cell unit, or may carry a cell unit which is not integral therewith. The floor panel sections 3*a*'' and 3*d*'' may comprise walls additional to the wall panels 8*a*' and 8*b*'. These walls may together form a cell unit.

Figure 4:
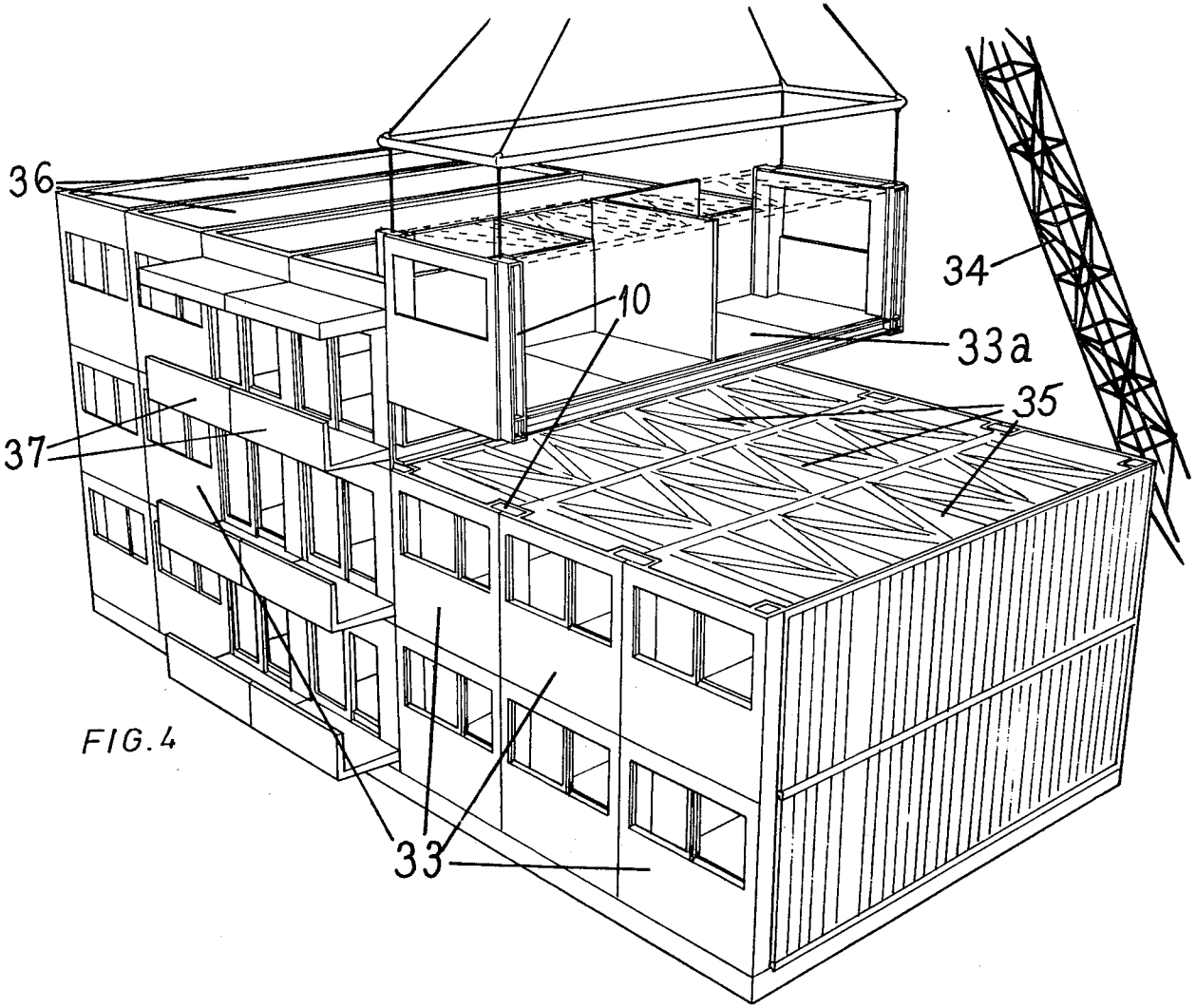
FIG. 4 shows a diagrammatic perspective view of a building according to the present invention in the course of construction.

FIG. 4 shows a plural storey building according to the present invention in the course of construction. As will be seen the building comprises a plurality of room elements 33 which have been mounted face-to-face and one upon another to form the building. A room element 33*a* is shown being lowered into position by means of a crane 34.

It will be observed that the uprights 10 of the load-bearing frames of the superposed room elements are in vertical alignment. Such vertically aligned uprights 10 are preferably connected together as by welding or bolting. The room elements of the lower storeys each have a ceiling 35 whilst from the left-hand side of the Figure it will be seen that the room elements of the upper storey have roof members 36 overlying them. It will also be seen that some of the room elements have a balcony 37.

What we claim is:

1. A method of constructing a transportable prefabricated room element comprising preparing a floor panel member having a horizontally extending channel therein, preparing a vertical structure having a vertically extending channel therein, preparing a load-bearing frame comprising a horizontal load-bearing beam and a vertical load-bearing beam, and assembling the floor panel member, the vertical structure and the load-bearing frame with the horizontal beam engaged in the horizontally extending channel and the vertical beam engaged in the vertically extending channel at a location remote from a building site to produce a transportable prefabricated room element.

2. A method of constructing a transportable prefabricated room element according to claim 1 including the steps of preparing a plurality of floor panel members having at least two perpendicular horizontally extending channels and assembling the floor panel members and the load-bearing frame with the horizontal beam engaged with aligned channels of the plurality of floor panel members and with a plurality of further horizontal beams engaged with perpendicularly extending channels of adjacent floor panel members.

3. A method of constructing a transportable prefabricated room element according to claim 1 wherein the floor panel member includes two horizontally extending channels at opposite sides thereof and the vertical structure includes two vertically extending channels at opposite sides thereof, and including the steps of preparing a further load-bearing frame comprising a horizontal load-bearing beam and a vertical load-bearing beam and assembling the floor panel member, the vertical structure and the load-bearing frames with the horizontal beams engaged in the horizontally extending channels at opposite sides of the floor panel member and the vertical beams engaged in the vertically extending channels at opposite sides of the vertical structure.

4. A method of constructing a building from a plurality of transportable prefabricated room elements comprising prefabricating each of a plurality of room elements by preparing a floor panel member having a horizontally extending channel therein, preparing a vertical structure having a vertically extending channel therein, preparing a load-bearing frame comprising a horizontal load-bearing beam and a vertical load-bearing beam, and assembling the floor panel member, the vertical structure and the load-bearing frame with the horizontal beam engaged in the horizontally extending channel and the vertical beam engaged in the vertically extending channel at a location remote from a building site to produce a transportable prefabricated room element, transporting the plurality of room elements to a building site, and mounting the elements in face-to-face relation to form a building.

5. A method of constructing a building according to claim 4 including the step of connecting the load-bearing frames of adjacent room elements to form a structural load-bearing frame for the building.

6. A method of constructing a building according to claim 4 including the step of mounting some of the plurality of room elements with their vertical load-bearing beams vertically aligned with and in supporting relation to the vertical load-bearing beams of other room elements to form a multistorey building.

7. A method according to claim 6 including the step of connecting the vertically aligned load-bearing beams to form a structural load-bearing frame for the building.

* * * * *